US007096181B2

(12) United States Patent
Jung et al.

(10) Patent No.: US 7,096,181 B2
(45) Date of Patent: Aug. 22, 2006

(54) METHOD FOR SEARCHING CODEBOOK

(75) Inventors: Sung Kyo Jung, Seoul (KR); Yong Soo Choi, Gwangmyeong-si (KR); Sung Wan Yoon, Goyang-si (KR); Kyung Tae Kim, Seoul (KR); Dae Hee Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 839 days.

(21) Appl. No.: 10/277,874

(22) Filed: Oct. 23, 2002

(65) Prior Publication Data

US 2003/0078771 A1 Apr. 24, 2003

(30) Foreign Application Priority Data

Oct. 23, 2001 (KR) ..... 2001-65278

(51) Int. Cl.
*G10L 19/14* (2006.01)

(52) U.S. Cl. ..... 704/222

(58) Field of Classification Search ..... None
See application file for complete search history.

(56) References Cited

U.S. PATENT DOCUMENTS 6,236,960 B1 * 5/2001 Peng et al. ..... 704/211
6,813,602 B1 * 11/2004 Thyssen ..... 704/222
6,847,929 B1 * 1/2005 Bernard ..... 704/223

* cited by examiner

*Primary Examiner*—Susan McFadden
(74) *Attorney, Agent, or Firm*—Fleshner & Kim LLP

(57) ABSTRACT

A method for searching a codebook which predicts a residual element of an input voice signal includes combining each track of the input signal, forming track units including at least two tracks, and determining a pulse code for each track. The method further includes calculating energy for each track using an energy formula including a vector dot product, arranging or selecting codewords in a small track energy order, and searching or selecting an optimal pulse for a single- or double-pulse track of the selected codeword.

15 Claims, 6 Drawing Sheets

FIG. 1

| Track | Position |
|---|---|
| $T_0$ | 0, 5, 10, 15, 20, 25, 30, 35, 40, 45, 50 |
| $T_1$ | 1, 6, 11, 16, 21, 26, 31, 36, 41, 46, 51 |
| $T_2$ | 2, 7, 12, 17, 22, 27, 32, 37, 42, 47, 52 |
| $T_3$ | 3, 8, 13, 18, 23, 28, 33, 38, 43, 48, 53 |
| $T_4$ | 4, 9, 14, 19, 24, 29, 34, 39, 43, 49, 54 |

FIG. 2

| Double-pulse Per Track Order $(p_0,p_1),(p_2,p_3),(p_4,p_5)$ | Single-pulse Per Track Order $(p_6,p_7)$ | Codeword (q) |
|---|---|---|
| $T_0-T_1-T_2$ | $T_3-T_4$ | '00' |
| $T_1-T_2-T_3$ | $T_4-T_0$ | '01' |
| $T_2-T_3-T_4$ | $T_0-T_1$ | '10' |
| $T_3-T_4-T_0$ | $T_1-T_2$ | '11' |

METHOD FOR SEARCHING CODEBOOK

BACKGROUND OF THE INVENTION

1. Field of the Invention

The present invention relates to performing a fixed codebook search of an enhanced variable-rate Codec (EVRC).

2. Background of the Related Art

The IS-127 EVRC was adopted as an 8 kbps voice encoder standard of TIA/EIA in 1996 and is being considered for use as a standard encoder in CDMA 2000. The IS-127 EVRC, which has been used in CDMA digital cellular systems, is a high performance voice encoder which provides toll quality second to 13 kbps Qualcomm code excited linear prediction (QCELP) used in PCS communications.

The EVRC has three data rates, namely a maximum data rate (Rate1, 8 kbps), an intermediate data rate (Rate1/2, 4 kbps), and a minimum data rate (Rate1/8, 1 kbps). It employs an encoding process which includes performing adaptive and fixed codebook searches for linear prediction and excited signal quantization. At this time, the fixed codebook search requires the highest computational complexity and occupies at least 40% of the whole encoding process.

More specifically, when voice information is inputted, an analyzer extracts a linear predictive coefficient (LPC), a pitch element (adaptive codebook search) and an energy, namely residual element (fixed codebook search). The fixed codebook search of the EVRC is based on an algebraic code-excited linear prediction (ACELP). The maximum data rate (Rate1) generates the highest computational complexity during the fixed codebook search.

FIG. 1 is a table showing each pulse position of an algebraic codebook at the maximum data rate of the EVRC. This fixed codebook is a 35-bit algebraic codebook at the maximum data rate (Rate1). In this codebook, all codebook vectors include eight pulses having a size of ±1, and a length thereof is 55 (0, 1, 2, . . . , 55). Its determinant is represented by $[55\times1]^t$.

One sub frame is randomly divided into five tracks $T_0$, $T_1$, $T_2$, $T_3$ and $T_4$ each having eleven pulse positions. The eleven pulses (0, 5, 10, . . . , 50), (1, 6, 11, . . . , 51), (2, 7, 12, . . . , 52), (3, 8, 13, . . . , 53) and (4, 9, 14, . . . 54) of the five tracks are randomly set up and searched, and thus tracks including two pulses and tracks including one pulse exist in the five tracks. That is, the five tracks $T_0$, $T_1$, $T_2$, $T_3$ and $T_4$ are combined to generate double-pulse per track including two pulses and single-pulse per track including one pulse.

FIG. 2 is a table showing codewords for track orders. In the fixed codebook at Rate1, numbers of cases of the double-pulse tracks and single-pulse tracks are divided into four codewords 00, 01, 10 and 11, and pulse searches are performed on every codeword. A code having the greatest codebook gain is selected, and its pulse position, pulse code and codebook gain are determined as optimal fixed codebook parameters. It is therefore evident that performing pulse searches (double-pulse track and single-pulse track) in this manner on four-track configuration codewords is very complicated.

More specifically, when the track configuration codeword is '00', a double-pulse per track order is $T_0$-$T_1$-$T_2$ and a single-pulse per track order is $T_3$-$T_4$ in the five tracks. When the track configuration codeword is '01', the double-pulse per track order is $T_1$-$T_2$-$T_3$ and the single-pulse per track order is $T_4$-$T_0$. When the track configuration codeword is '10', the double-pulse per track order is $T_2$-$T_3$-$T_4$ and the single-pulse per track order is $T_0$-$T_1$. And, when the track configuration codeword is '11', the double-pulse per track order is $T_3$-$T_4$-$T_0$ and the single-pulse per track order is $T_1$-$T_2$.

In the single-pulse track, one of $T_3$-$T_4$, $T_4$-$T_0$, $T_0$-$T_1$ and $T_1$-$T_2$ is selected, encoded using a 2-bit ($P_6$, $P_7$) codeword, and transmitted to a receiving end. In the double-pulse track, two pulse positions and codes are encoded each using an 8-bit codeword ($P_0$, $P_1$), ($P_2$, $P_3$) and ($P_4$, $P_5$). Accordingly, a total of 35-bits {=2+(7+2)+(8×3)} are necessary for the encoding process of the algebraic codebook.

The EVRC fixed codebook is an algebraic codebook which has advantages in storage performance and computational complexity. The structure of the EVRC fixed codebook is based on an interleaved single-pulse permutation (ISPP) design. The codebook search is a process for searching a codebook factor and a codebook gain which minimizes a weighted mean square error between an original signal and a combined signal, and is performed in sub frame units.

FIG. 3 is a flowchart showing a conventional fixed codebook search of the EVRC. This algebraic codebook search involves searching the algebraic codebook to minimize the mean square error between the weighted original signal and the weighted combined signal. For this, a fixed codebook object signal $(x_w)[N\times1]$ and an impulse response matrix H[N×N] are obtained through LPC analysis, residual signal correction, and adaptive codebook search processes.

In an initial step of the method, a vector dot product (d)[N×1] and an autocortelation function (ϕ)[N×N] are calculated using the fixed codebook target signal and the impulse response matrix (S301). That is, the vector d is calculated by multiplying the impulse response matrix H by the fixed codebook object signal $x_w$, and the autocorrelation function ϕ is calculated by mutually multiplying the impulse response matrix H.

Next, a pulse sign (±1) is determined in pulse positions existing in each track (S302). The pulse sign is previously determined according to code information of a reference signal which is a weighted sum of the object signal x(n) of a residual domain and the vector dot product d.

Finally, after the pulse code is determined, an optimal pulse position is searched from the vector dot product d which is a signal backward-filtered from each codeword and the autocorrelation function ϕ (S303). This procedure is repeated to search the pulse positions. That is, the optimal pulse for each codeword 00, 01, 10 and 11 is searched by using the calculated vector dot product, autocorrelation function and pulse code determined in every pulse position.

The codebook search is identical to the process for searching a code vector $C_k$ maximizing a search standard $T_k$ as represented by Formula 1:

$$T_k = \frac{(d_t c_k)^2}{c_k^t \Phi c_k} \tag{1}$$

Here, the vector dot product ($d=H^t x_w$) is a backward filtered signal obtained by passing the given object signal $(x_w)[N\times1]$ through the weighted combined filter H[N×N], the autocorrelation function ($\phi=H^tH$) is an impulse response correlation matrix of the weighted combined filter, and k is a number of cases.

The vector dot product (d)[N×1] and the autocorrelation function (ϕ)[N×N] are previously calculated before the codebook search, and computational complexity thereof is in proportion to a square of a length of the sub frame.

In the EVRC, the pulse sign (±1) is predetermined in each position of the tracks to simplify the codebook search for determining the optimal codebook vector. The optimal pulse position is then obtained based on Formula 1.

FIG. 4 shows steps included in the conventional fixed codebook search of the EVRC. In the first step, the fixed codebook object signal $x_w$ and the impulse response matrix H are obtained through an LPC analysis and residual signal correction and adaptive codebook search processes (S401).

In the second step, the backward filtered target vector dot product d and the autocorrelation function ϕ are calculated using the fixed codebook object signal $x_w$ and the impulse response matrix H of the first step as represented by Formula 2 (S402):

$$d=H^t x_w$$

$$\phi=H^t H \tag{2}$$

In the third step, the pulse sign (±1) is determined by using the vector dot product d of the second step (S403).

In the four given track configuration codewords ($j_{th}$=0, 1, 2, 3) of FIG. 2, the pulse searches are respectively done on the pulse positions of the given tracks $T_0$, $T_1$, $T_2$, $T_3$ and $T_4$ of FIG. 1, and the track configuration codeword maximizing the search standard $T_k$ in Formula 1 is selected. That is, when the codeword order $j_{th}$ is '0', the five tracks $T_0$, $T_1$, $T_2$, $T_3$ and $T_4$ are combined in the $0^{th}$ codeword, and the pulse searches of the double-pulse track $T_0$-$T_1$-$T_2$ including two pulses and the single-pulse track $T_3$-$T_4$ including one pulse are done on the $0^{th}$ codeword combination configuration track (S404). In the same manner, the pulse searches of the double-pulse track and the single-pulse track which satisfy each codeword combination configuration track are sequentially performed in the succeeding codeword orders $j_{th}$=1(01), $j_{th}$=2(10) and $j_{th}$=3(11) (S405–S407).

After the pulse searches are done in each codeword order, when the search codeword $J_{th}$ exceeds 3(11), the codeword order $j_{th}$ having the greatest codebook gain, namely the codeword $C_k$ maximizing the search standard $T_k$ in Formula 1, is selected in the fourth step (S408). When the codeword is selected, the pulse position, pulse code and codebook gain of the corresponding track configuration codeword are determined as the optimal fixed codebook parameters (S409). That is, in the fourth step, the pulse position, pulse sign (±1) and codebook gain (scale) of the track configuration codeword c calculated in the third step are determined as the optimal fixed codebook parameters.

The process for obtaining the fixed codebook object signal $x_w$ and the impulse response matrix H through LPC analysis and residual signal correction and adaptive codebook search processes has been generally performed and therefore a detailed explanation is omitted. Also generally performed is the process for selecting the track configuration codeword that maximizes the search standard $T_k$ in Formula 1 by doing pulse searches on the pulse positions of the tracks $T_0$, $T_1$, $T_2$, $T_3$ and $T_4$ of FIG. 1 in four given track configuration codewords ($j_{th}$=0, 1, 2, 3), using the vector dot product d, the autocorrelation function ϕ and the pulse code (±1) determined by using the vector dot product d. A detailed explanation of this process is therefore also omitted.

In the conventional fixed codebook search performed at the maximum data rate, the track configuration codeword searches of FIG. 2 and the pulse position searches of FIG. 1 in each codeword double-pulse track and single-pulse track must be performed. This increases computational complexity. More specifically, as described above, the numbers of cases of the double-pulse tracks and the single-pulse tracks are divided into four codewords, and the pulse searches are done on each codeword. The codeword having the greatest codebook gain is then selected and its pulse position, pulse code and codebook gain are determined as optimal fixed codebook parameters. The pulse searches must therefore be performed on the four track configuration codewords. This increases computational complexity and therefore adversely affects the overall cost and efficiency of the system.

SUMMARY OF THE INVENTION

An object of the invention is to solve at least the above problems and/or disadvantages and to provide at least the advantages described hereinafter.

Accordingly, one object of the present invention is to solve the foregoing problems by providing a method for searching a codebook which can reduce computational complexity of residual signal correction and fixed codebook search by, firstly, searching a track configuration codeword and, then, searching a pulse position of the searched codeword.

Another object of the present invention is to provide a method for searching a codebook which obtains each track energy and determines a value minimizing a sum of the two track energies as a track configuration codeword.

The foregoing and other objects and advantages are realized by providing a method for searching a codebook which calculates each track energy by using an energy formula including a vector dot product, arranges/selects codewords in a small track energy order, and searches/selects an optimal pulse for single/double-pulse tracks of the selected codeword.

According to the present invention, the method for searching the codeword calculates each track energy in the fixed codebook search and previously determines a value minimizing a sum of the two track energies as a track configuration codeword to individually perform the track configuration codeword search and the pulse position search, thereby simplifying the fixed codebook search process and reducing computational complexity without deteriorating combined voice.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 1 is a table showing each pulse position of an algebraic codebook at a maximum data rate of the EVRC;

FIG. 2 is a table showing codewords for track orders of the EVRC.

DETAILED DESCRIPTION OF PREFERRED EMBODIMENTS

The following detailed description is directed to a method for searching a codebook according to a preferred embodiment of the invention with reference to the accompanying drawings.

Figure 5:
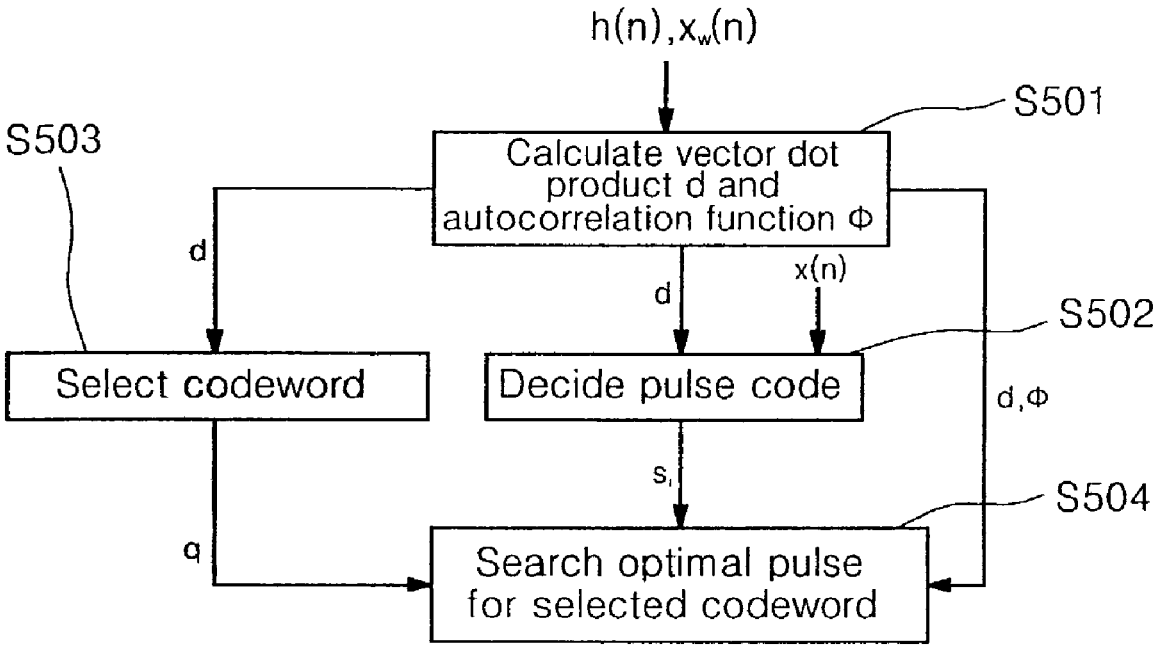
FIG. 5 is a flowchart showing fixed codebook search of the EVRC in accordance with a preferred embodiment of the present invention.
Figure 6:
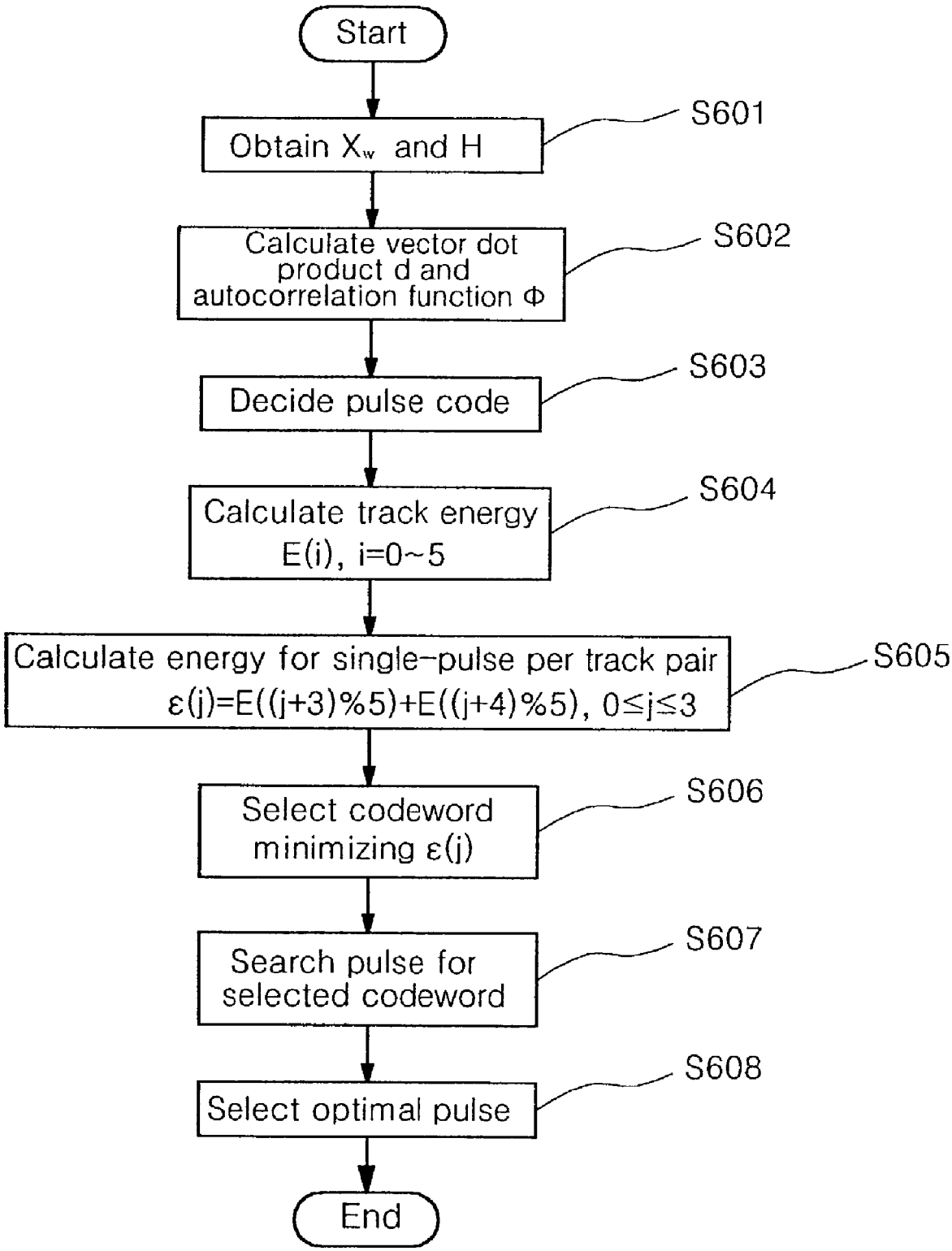
FIG. 6 is a flowchart showing a method for searching a fixed codebook of the EVRC in accordance with the preferred embodiment of the present invention.

FIG. 5 is a flowchart showing steps included in a fixed codebook search of an EVRC in accordance with a preferred embodiment of the present invention, and FIG. 6 is a flowchart showing the method for searching the fixed codebook of the EVRC in accordance with the preferred embodiment of the present invention.

Figure 3:
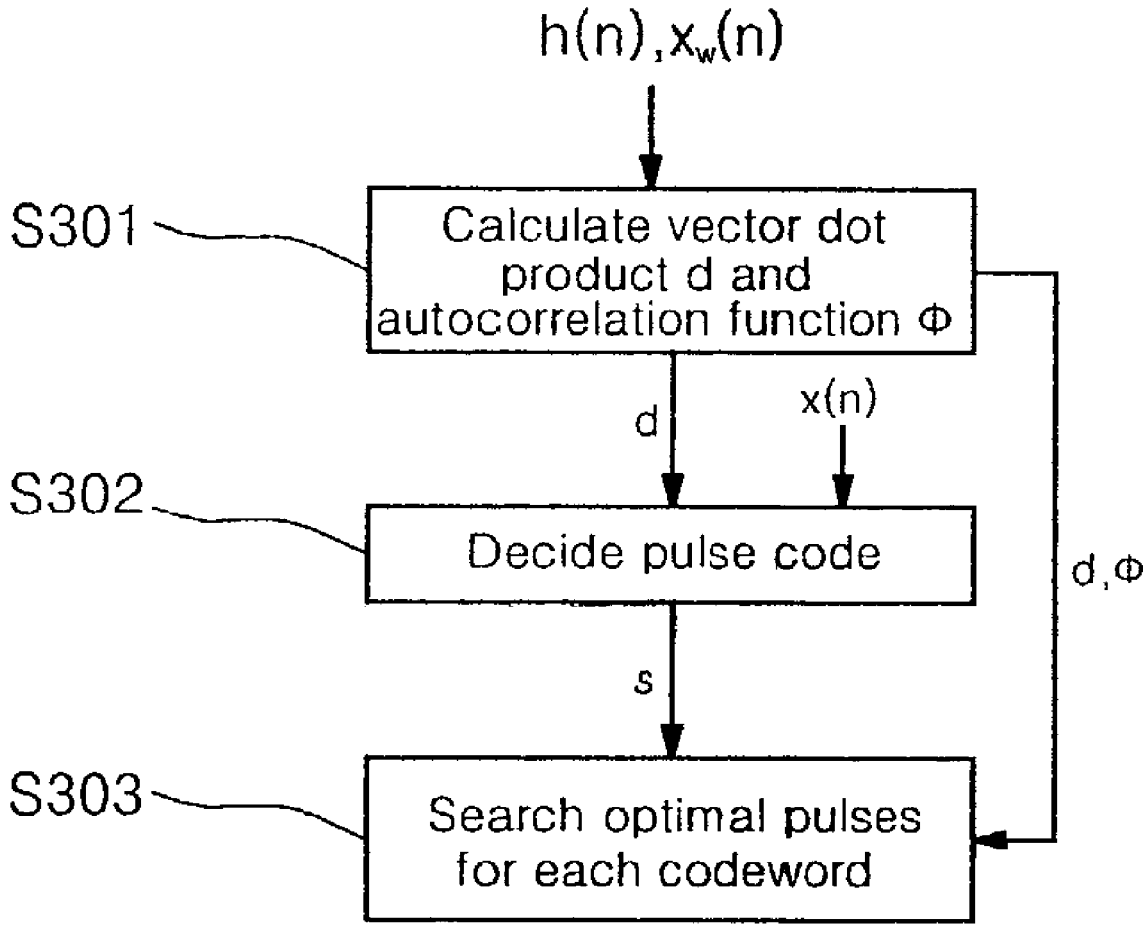
FIG. 3 is a flowchart showing general fixed codebook search of the EVRC.
Figure 4:
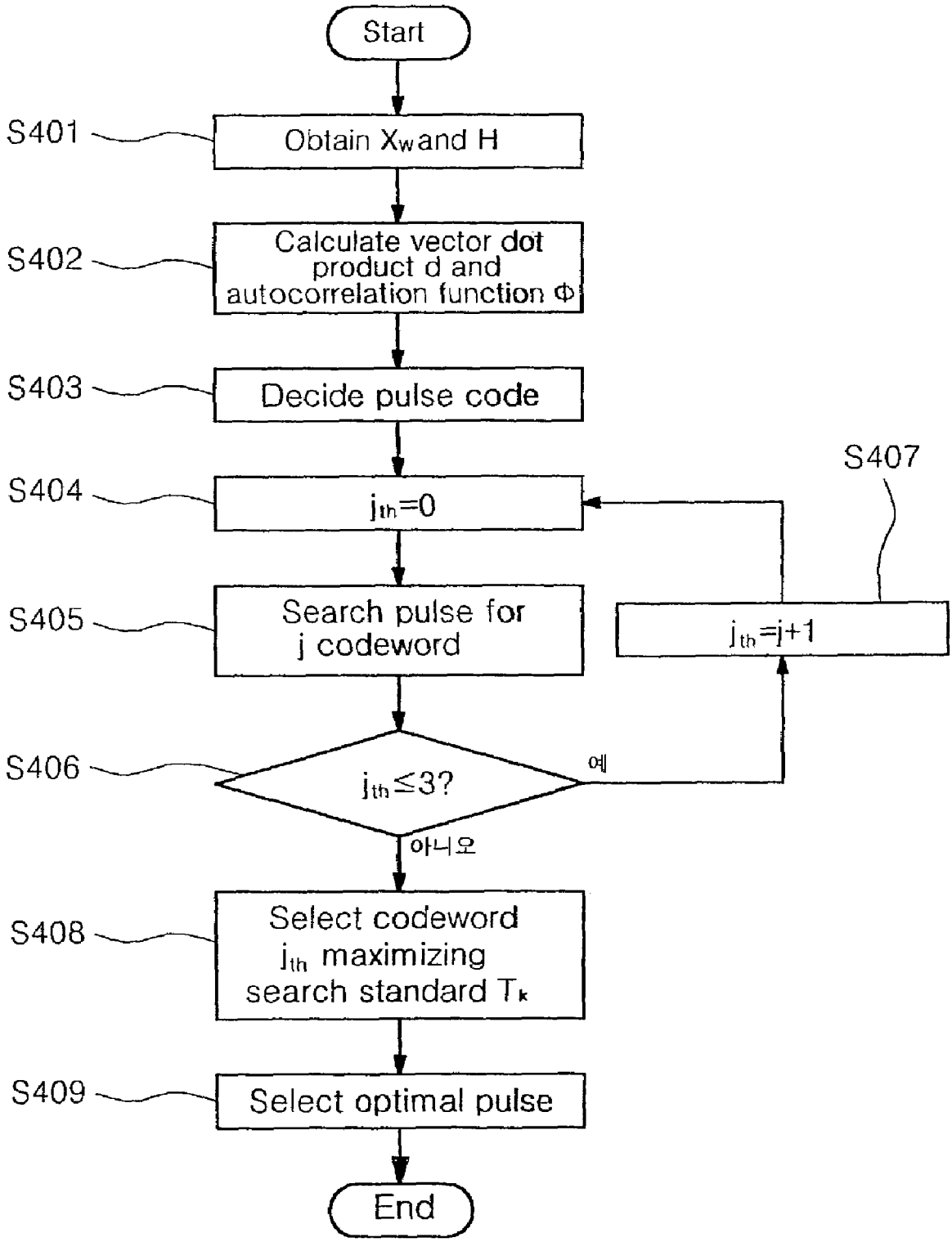
FIG. 4 is a flowchart showing a conventional method for searching a fixed codebook of the EVRC.

Referring to FIG. 5, a fixed codebook object signal $X_w$ and an impulse response matrix H are obtained through LPC analysis, residual signal correction and adaptive codebook search processes, and a vector dot product ($d=H^t x_w$) and an autocorrelation function ($\phi=H^t H$) are respectively calculated by using the fixed codebook object signal $X_w$ and the impulse response matrix H (S501), which may be a general process identical to S301 of FIG. 3.

A pulse sign $s_i$ is determined by the vector dot product and the fixed codebook target signal (S502). Each track energy is calculated using the vector dot product d, and a track configuration codeword q included in a track pair having a minimum energy for a single-pulse track pair among the calculated energies is selected (S503). The track configuration codeword determination is individually performed from the pulse position search.

In accordance with the present invention, the pulse implies a signal element and a size of the track energy is dependent upon the number of pulses. That is to say, the track configuration codewords of FIG. 2 may be individually determined from the pulse search of FIG. 1.

Accordingly, in order to determine the track configuration codeword, the energies E(i) distributed in each track i are calculated using the previously-determined vector dot product before the codebook search is performed. This is represented by Formula 3:

$$E(i) = \underset{n=0}{\overset{10}{Q}} d^2(5n+i),\ 0DiD4 \tag{3}$$

In the above formula, i represents a track and n is pulse position 0 to 10. The track distribution energies determine the track configuration codewords (q=00, 01, 10, 11).

An optimal pulse is searched by searching the pulse positions of FIG. 1 using the pulse sign $s_1$, the track configuration codeword q, the vector dot product d and the autocorrelation function $\phi$ (S504). The aforementioned process will now be explained in detail with reference to FIG. 6.

The fixed codebook target signal $X_w$ and the impulse response matrix H are obtained through the LPC analysis, residual signal correction and adaptive codebook search processes, and the vector dot product ($d=H^t x_w$) and the autocorrelation function ($\phi=H^t H$) are respectively calculated using the fixed codebook target signal $X_w$ and the impulse response matrix H (S601).

The pulse code $s_1$ is determined according to the vector dot product and the fixed codebook target signal (S602 and S603).

The pulse code (±1) is determined in the pulse positions of each track (S603). Such a pulse code is previously determined according to code information of a reference signal which is a weighted sum of the target signal x(n) of a residual domain and the vector dot product d. That is, the pulse sign $s_1$ is determined according to the vector dot product d and the fixed codebook target signal (S603), each track energy is calculated using the vector dot product d, and the track configuration codeword q included in the track pair having the minimum energy for the single-pulse track pair among the calculated energies is selected. The track configuration codeword determination is individually performed from the pulse position search. That is, the track configuration codewords of FIG. 2 may be determined independent of the pulse search of FIG. 1.

Accordingly, in order to determine the track configuration codeword, the energies E(i) distributed in each track may be calculated using the previously-determined vector dot product before the codebook search (S604).

The energies E(i) distributed in each track are preferably calculated using Formula 3. The track distribution energies E(i) may be obtained by multiplying energies of all pulse positions existing in each track $T_0$, $T_1$, $T_2$, $T_3$ and $T_4$ by a squared value of the vector dot product d, and then adding the whole pulse energy to the resultant value.

In applying Formula 3, E(0) is the track distribution energy which is a sum of the energies of the whole positions existing in the first track $T_0$, E(1) is the track distribution energy which is a sum of the energies of the whole positions existing in the second track $T_1$, E(2) is the track distribution energy which is a sum of the energies of the whole positions existing in the third track $T_2$, E(3) is the track distribution energy which is a sum of the energies of the whole positions existing in the fourth track $T_3$, and E(4) is the track distribution energy which is a sum of the energies of the whole positions existing in the fifth track $T_4$.

The track configuration codewords {E(3),E(4)},{E(4),E(0)},{E(0),E(1)} and {E(1),E(2)} are determined using the respective track distribution energies. For this, energies $\epsilon(j)$ for the single-pulse track pairs of each track configuration codeword are calculated rather than energies for the double-pulse track pairs having a high value. The energy for the single-pulse track pair is obtained by adding the two track distribution energies (S605). The energies $\epsilon(j)$ for the single-pulse track pairs are mutually compared, and the energy for the single-pulse track pair having a minimum value is selected as the track configuration codeword $j_{th}$ (S606). In addition, the pulse positions of the single-pulse tracks and the double-pulse tracks are searched merely on the selected track configuration codeword $j_{th}$ (S607).

Here, selection of the minimum energy value implies selection of few pulses. More specifically, the respective track distribution energies are calculated, the energies {E(3)+E(4)},{E(4)+E(0)},{E(0)+E(1)} and {E(1)+E(2)} for the single-pulse track pairs are formed by using the track distribution energies, and the minimum value of the energies for the single-pulse track pairs is searched to select the track distribution codeword.

The energies $\epsilon(j)$ for the single-pulse track pairs are preferably calculated using the track distribution energies E(i) represented by Formula 4:

$$\epsilon(j)=E(j+3)\%5)+E((j+4)\%5),\ 0\leqq j\leqq 3 \quad (4)$$

Here, % represents a modulo operation.

When 0 to 3 are introduced to j of Formula 4, the sum of the energies for the single-pulse track pairs is obtained.

$\epsilon(0)=E(3)+E(4), \epsilon(1)=E(4)+E(0)$ $\epsilon(2)=E(0)+E(1), \epsilon(3)=E(1)+E(2)$ The minimum value of the sum of the energies $\epsilon(j)$ for each single-pulse track pair is searched among the four energies $\epsilon(0)$, $\epsilon(1)$, $\epsilon(2)$ and $\epsilon(3)$ for the single-pulse track pairs, and its track configuration codeword order $j_{th}$ is obtained.

When the minimum value of the sum of the energies $\epsilon(j)$ for each single-pulse track pair is {E(3)+E(4)}, the track configuration codeword $j_{th}$ is determined as q=0("00"), when it is {E(4)+E(0)}, the track configuration codeword $j_{th}$ is determined as q=1("01"), when it is {E(0)+E(1)}, the track configuration codeword $j_{th}$ is determined as q=2("10"), and when it is {E(1)+E(2)}, the track configuration codeword $j_{th}$ is determined as q=3("11").

The single-pulse track and the double-pulse track as shown in FIG. 2 are determined in the decided track configuration codeword order, and the pulse searches are done on each track as shown in FIG. 1, thereby obtaining the optimal pulse position, pulse code and fixed codebook gain (S608).

Figure 7:
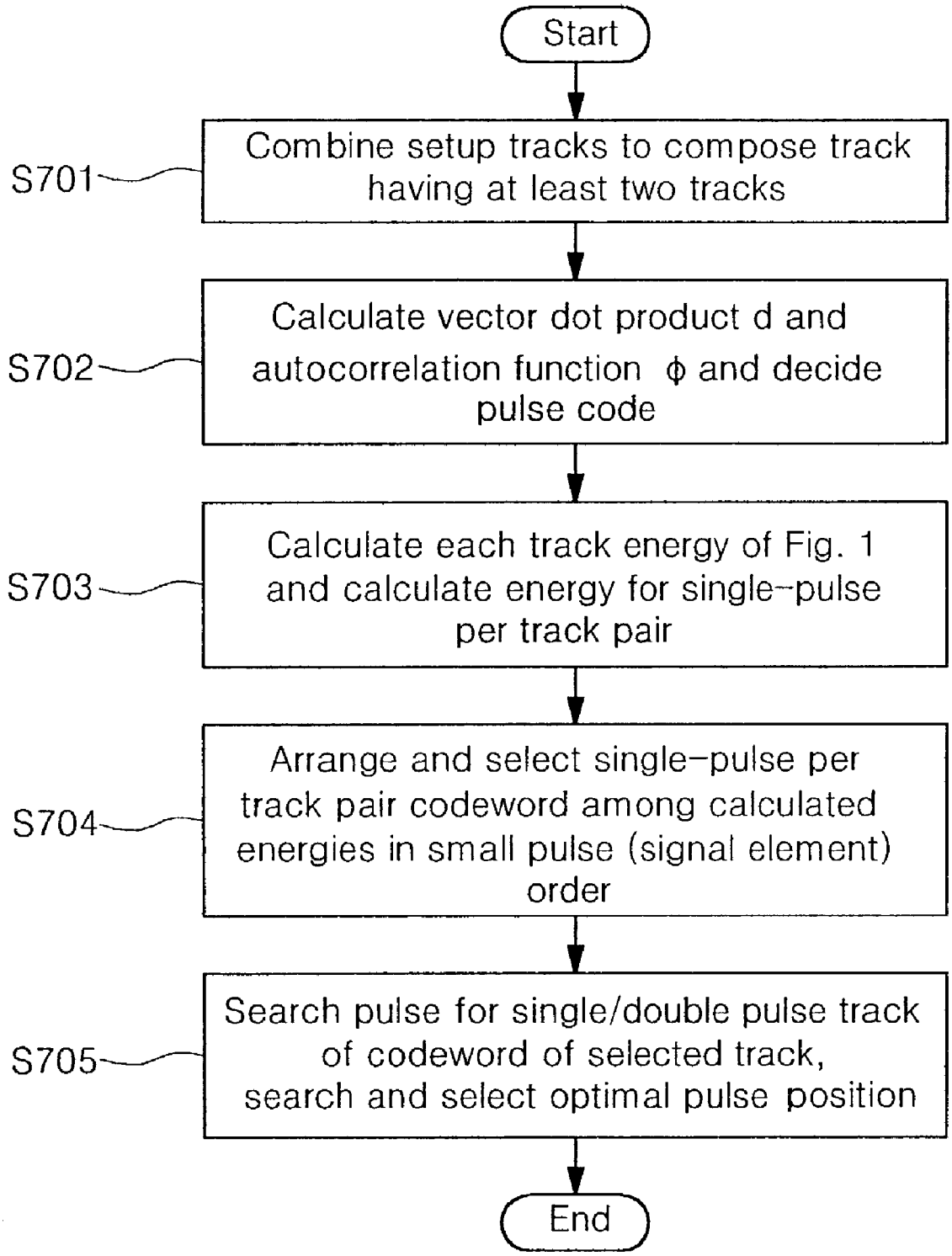
FIG. 7 is a flowchart showing a process for firstly selecting a codeword by using energies of single-pulse track pairs, and searching an optimal pulse position for the selected codeword.

FIG. 7 is a flowchart showing a process for firstly selecting the codeword using the energies of the single-pulse track pairs, and then searching the optimal pulse position for the selected codeword. The single-pulse track and the double-pulse track including at least two tracks are formed by combining the tracks as shown in FIG. 2 in the tracks set up in FIG. 1 (S701). Thereafter, the pulse code is determined by calculating the vector dot product d and the autocorrelation function $\phi$ (S702). Steps S701 and S702 may be performed in the same manner as the conventional art.

The energies of each track of FIG. 1 are preferably calculated by Formula 3, and the energies of the single-pulse track pairs are calculated by Formula 4 (S703).

The minimum value of the calculated energies has few pulses (signal elements), and thus the minimum energy is selected and arranged as the single-pulse track pair (S704).

The track configuration codeword order jth is obtained by comparing the minimum values of the sums of the energies $\epsilon(j)$ of each single-pulse track pair.

The pulse searches are done on the single/double-pulse tracks of the codeword of the selected track, thereby searching/selecting the optimal pulse position.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method for searching a codebook which extracts a residual element of an input voice signal, comprising:

forming track units including at least two tracks of the input voice signal;

determining a pulse sign for each of said tracks;

calculating track energies for said tracks;

selecting a codeword based on an amount of the track energies; and searching or selecting an optimal pulse for one of said tracks corresponding to the selected codeword.

2. The method according to claim 1, further comprising:

extracting the residual element by extracting the fixed codebook.

3. The method according to claim 1, further comprising:

selecting as an optimal codeword a value which minimizes a sum of the track energies corresponding to single-pulse tracks of each code word.

4. The method according to claim 3, further comprising:

searching a minimum value of sums of the track energies of a plurality of single-pulse track pairs; and obtaining a track configuration codeword order based on the minimum value.

5. A method for searching a codebook which extracts a residual element of an input voice signal, comprising:

forming track units including at least two tracks of the input voice signal;

determining a pulse code for each of said tracks;

obtaining track energies for said tracks by calculating a sum of energies of a signal obtained by backward filtering a fixed codebook target signal in a predetermined number of pulse positions of the track;

selecting a codeword based on an amount of the track energies; and searching or selecting an optimal pulse for one of said tracks corresponding to the selected codeword.

6. A method for searching a codebook, comprising:

obtaining a fixed codebook target signal and an impulse response matrix through at least one of a linear predictive coefficient analysis, a residual signal correction process, and adaptive codebook search process performed on voice information;

calculating a vector d and an autocorrelation function using the fixed codebook target signal and the impulse response matrix;

computing energies distributed in each of a plurality of tracks of the voice information using the vector d;

calculating energies for single-pulse track pairs using the detected track distribution energies;

selecting a track pair which minimizes the single-pulse track pair energy as a track configuration codeword;

determining a single-pulse track and a double-pulse track based on the selected track configuration codeword; and performing a pulse search on the selected tracks.

7. The method according to claim 6, wherein each of said track distribution energies determines a track energy as a sum of energies in all positions of each track.

8. The method according to claim 6, wherein each track distribution energy is calculated by:

$$E(i) = \underset{n=0}{\overset{10}{Q}} d^2(5n+i),\ 0DiD4$$

where n represents a pulse position of the track, and i represents a track.

9. The method according to claim 8, wherein the vector dot product ($d=H'x_w$) is a backward filtered signal obtained by passing a fixed codebook search object signal ($x_w$) through a weighted combined filter H.

10. The method according to claim 6, wherein the energies for each single-pulse track pair are obtained by adding two track distribution energies.

11. The method according to claim 10, wherein the energies for each single-pulse track pair are obtained from a sum of two track distribution energies using the energies for the single-pulse track pairs $\epsilon(j)=E((j+3)\%5)+E((j+4)\%5)$, $0 \leqq j \leqq 3$.

12. The method according to claim 11, wherein % represents a modulo operation.

13. The method according to claim 6, wherein the track configuration codeword is determined using a minimum value of the sum of energies of two single-pulse tracks.

14. The method according to claim 13, wherein a minimum value of the energies $\epsilon(0)=E(3)+E(4)$, $\epsilon(1)=E(4)+E(0)$, $E(2)=E(0)+E(1)$ and $\epsilon(3)=E(1)+E(2)$ for the single-pulse track pairs is selected as the track configuration codeword minimizing the energy for the single-pulse track pair.

15. The method according to claim 6, wherein the track configuration codeword search is independently performed from the pulse position search.

* * * * *